United States Patent [19]

Neva et al.

[11] Patent Number: 5,065,554

[45] Date of Patent: Nov. 19, 1991

[54] SHELL STRUCTURE

[76] Inventors: Pertti Neva, Näsilinnankatu 28 E, SF-33200 Tampere; Ralf Lindberg, Timpurinkatu 17, SF-33720 Tampere, both of Finland

[21] Appl. No.: 488,014

[22] PCT Filed: Nov. 4, 1988

[86] PCT No.: PCT/FI88/00179

§ 371 Date: May 4, 1990

§ 102(e) Date: May 4, 1990

[87] PCT Pub. No.: WO89/04404

PCT Pub. Date: May 18, 1989

[30] Foreign Application Priority Data

Nov. 5, 1987 [FI] Finland ..... 874886

[51] Int. Cl.[5] ..... E04B 7/00

[52] U.S. Cl. ..... 52/82; 52/80

[58] Field of Search ..... 52/80, 81, 82

[56] References Cited

U.S. PATENT DOCUMENTS 2,423,832 2/1949 Gearon .
2,460,662 7/1947 Van Voorhis .
2,897,668 8/1959 Graham .
3,154,888 11/1964 Graham ..... 52/80
3,902,288 9/1975 Knudson .
3,968,603 7/1976 Merson .

FOREIGN PATENT DOCUMENTS 3242080 6/1982 Fed. Rep. of Germany .
3024437 11/1982 Fed. Rep. of Germany .

*Primary Examiner*—Richard E. Chilcot, Jr.
*Assistant Examiner*—Creighton Smith
*Attorney, Agent, or Firm*—Pollock, Vande Sande & Priddy

[57] ABSTRACT

A shell structure comprises a single body of reinforced plastic defining a hollow, open bottom housing member which includes an elongate portion having a substantially parabolic cross-sectional shape and two gables closing the elongate portion at the opposite ends thereof. The gables are inclined towards the central plane of the housing member, and a flange-shaped reinforcement portion extends along the edge of the open bottom of the housing member. The elongate member and the two gables are corrugated such that their corrugations extend substantially perpendicularly to the edge of the open bottom and wherein the corrugations of the elongate portion and the inclined gable extend in the same phase at junctures between the elongate portion and the gables.

12 Claims, 6 Drawing Sheets

SHELL STRUCTURE

FIELD OF THE INVENTION

The present invention relates to a shell structure, comprising an elongated housing section and two gables which join the housing section and whose bottom edges define an opening in the shell structure, and the use of such shell structures as dugouts.

BACKGROUND OF THE INVENTION

This type of a shell structure has several applications, in civilian application as underground cellars, public shelters, storages, and the like. In military application, such shell structures can be used as dugouts.

For example, U.S. Pat. No. 3,968,603 describes prefabricated metal buildings consisting of a plurality of individual U-shaped building elements, which are connected with each other, and the like, by means of clamps or other suitable fasteners. Reinforcing web structures are necessary to stabilize the buildings. Erecting such buildings requires specific tools, is time consuming and requires considerable labor. Due to their enormous weight, these structures cannot be moved from one place to another as a whole. These structures must be dismantled for this purpose, which again requires specific tools, and is time and labor consuming.

SUMMARY OF THE INVENTION

It is therefore an object of this invention to provide a multi-purpose shell structure which satisfies the following requirements. The shell structure is simple to manufacture, comprises a single body, is light and easily stackable. It can also be erected without special tools or special equipment. According to another object, a shell structure of the present invention is watertight and thus can be used either as an above-ground shelter structure or an underground dugout structure.

BRIEF DESCRIPTION OF THE DRAWINGS

In order to achieve these objects a shell structure according to the characterizing part of claim 1 is provided.

Other preferred embodiments of the invention are set forth in the dependent claims 2 to 4. According to independent claim 5, the use of the shell structure as a dugout is provided.

The invention will now be described in more detail in the following specification with reference made to an embodiment shown in the accompanying drawings. In the drawings

DETAILED DESCRIPTION OF THE PREFERRED EMBODIMENT(S)

Figure 1:
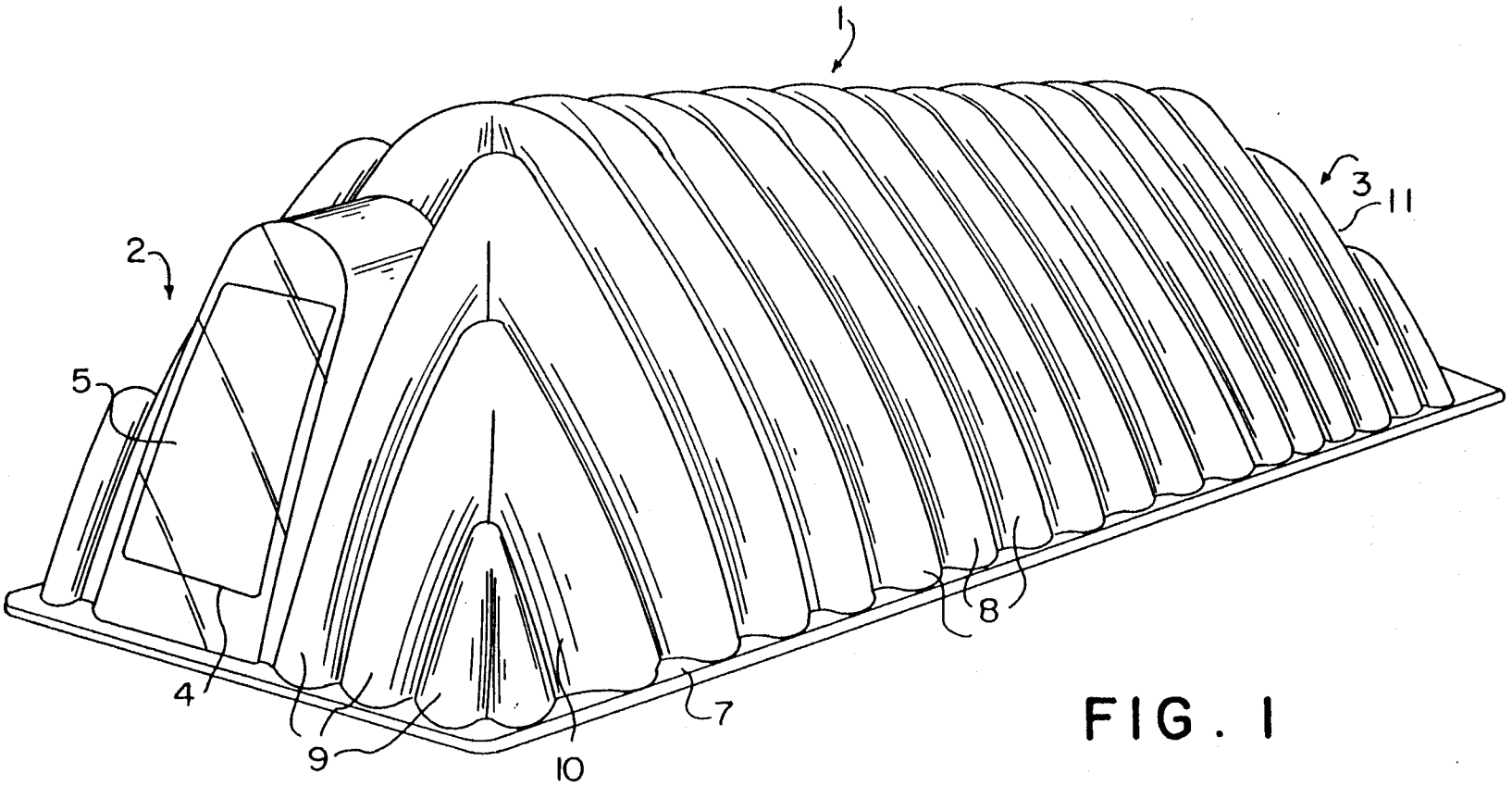
FIGS. 1 and 2 are perspective views of a shell structure of the invention as seen from the outside.
Figure 2:
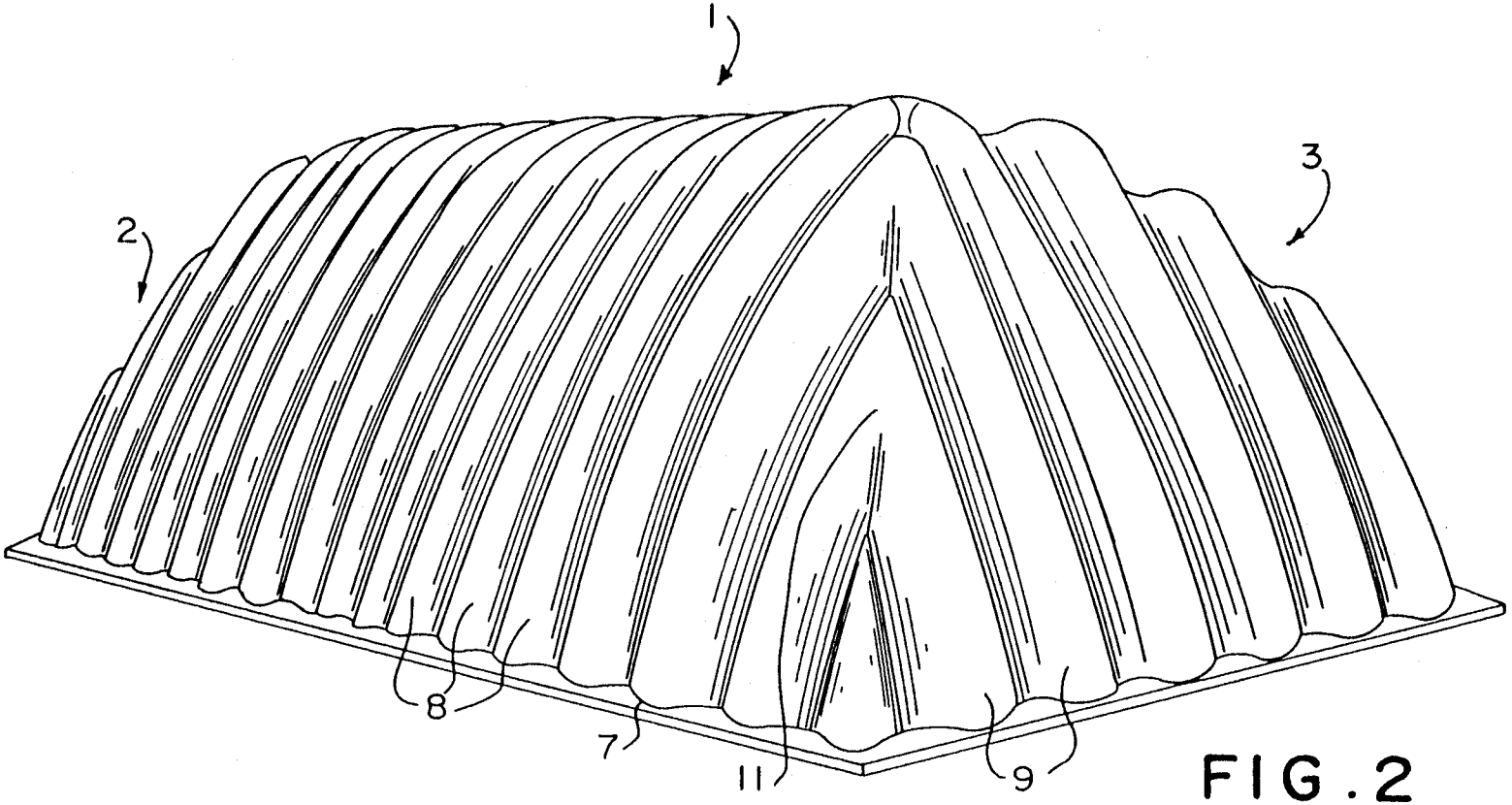
Figure 3:
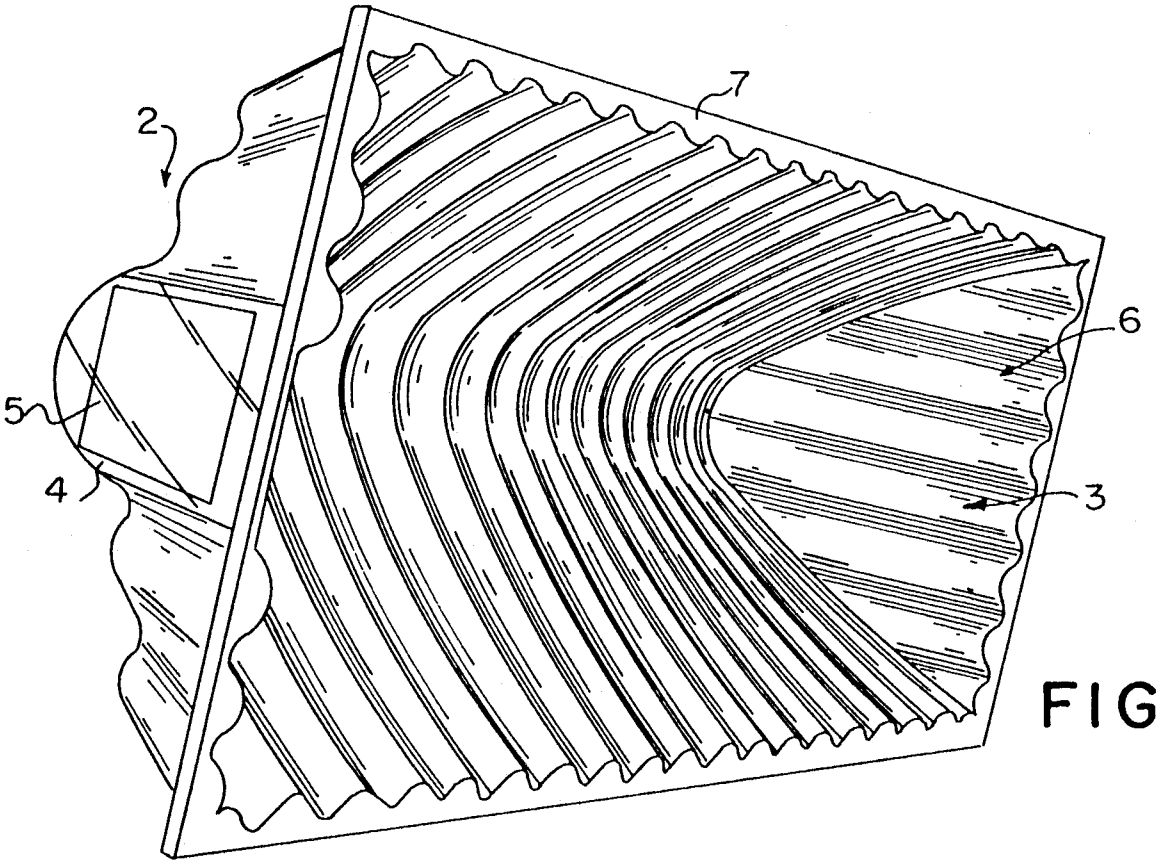
FIG. 3 is also a perspective view but shows the interior of a shell structure.
Figure 4:
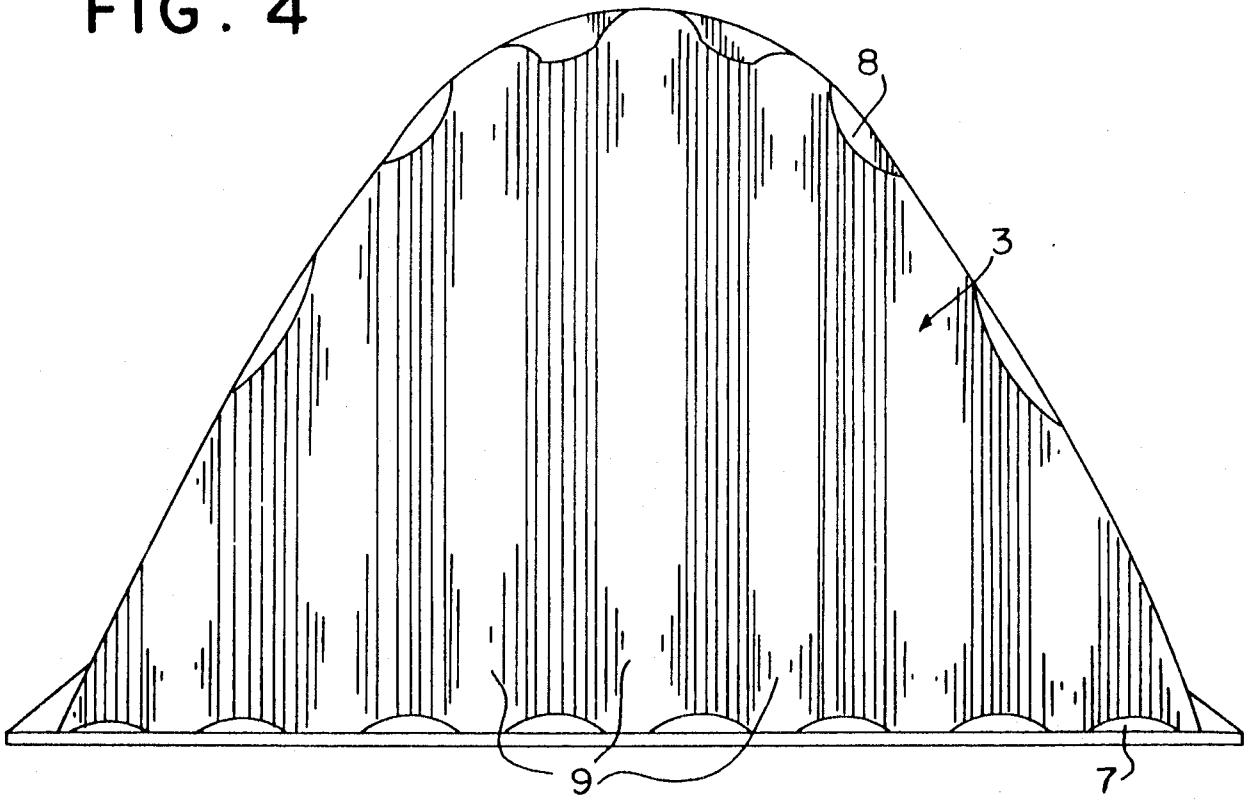
FIG. 4 shows a shell structure as seen towards one of the gables

Referring particularly to FIGS. 1–4, a shell structure comprises an elongated cylindrical housing section 1 having a parabolically shaped cross-section. The housing section is trough-like and provided with gables 2 and 3. A first gable 2 includes an opening 4 in which is fitted a watertightly closeable door or hatch 5. The edges of elements 1–3 define an opening 6 into the shell structure (FIG. 3). Running along the rim of opening 6 is a flange-shaped reinforcement 7. Both housing section 1 and each gable 2 and 3 are made of a corrugated sheet material. The sheet form has been achieved by using in reinforced plastic technology, laminating together layers of plastic and reinforced plastic upon a reinforced plastic mould matching the shape of a shell structure. Particularly, when manufacturing a shell structure of reinforced plastic, a corrugated structure can provide highly preferred strength values. Housing section 1 is provided with corrugations 8 which are perpendicular to the longitudinal direction of the housing section; such corrugations are made vertical when a shell structure is positioned with opening 6 against the ground. Similarly, the gables have corrugations 9 positioned substantially perpendicularly to the gable edge, so that they lie in a substantially vertical position when a shell structure lies with opening 6 against the ground. It should be particularly noted that corrugations 8 and 9 in housing section 1 and gables 2, 3 are arranged to extend in the same phase at junctures between said elements 1, 2 and 3 of the shell structure.

When the cross-section of housing section 1 is formed into a parabolically, hyperbolically or otherwise arch-shaped through-like cylindrical surface whose cross-section is constant and, on the other hand, gables 2 and 3 are made rectilinear at the reinforcement 7 of the edge, the edges of the above-mentioned elements define a substantially rectangular housing section opening 6.

Reinforcement 7 can be fitted with lifting handles or a string running through holes in the flange for relocating a shell structure.

Figure 5:
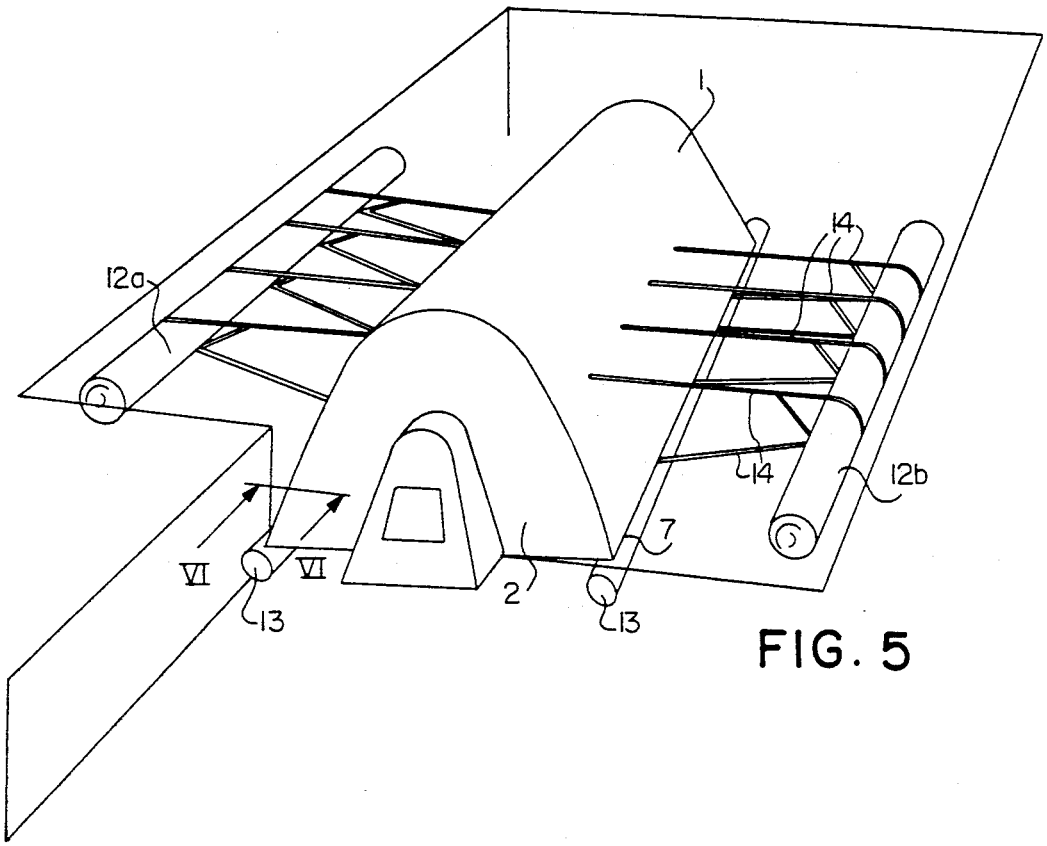
FIGS. 5 and 6 illustrate the application of a shell structure as a dugout.
Figure 6:
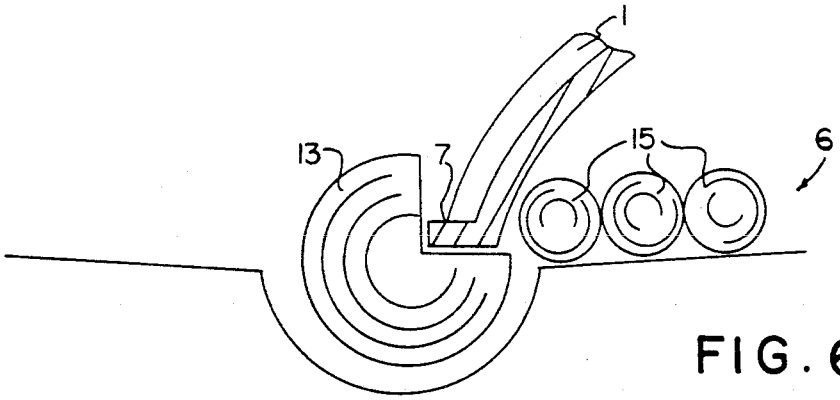

Especially FIGS. 5 and 6 illustrate the application of a shell structure of the invention as a dugout. A shell structure 1–3 is positioned in a pit dug in the ground with opening 6 facing downwards. Housing section 1 is fitted with tensile stress transmitting members, such as strings 14 or the like, which extend on either side of the housing section e.g. through housing section piercing holes and/or through reinforcement 7 and which are fastened to logs 12*a*, 12*b* extending lengthwise of the housing section. Reinforcement 7 is supported on a log 13 (FIG. 6) and opening 6 is provided with a dugout bottom covering, such as parallel blocks 15. This way a dugout embedded in the ground can be made of a very sturdy construction as a combination of the inherent strength of a shell structure and an additional effect provided by strings 14 or the like. Within the scope of the invention it is also possible to combine dugouts to form underground dugout systems for most varying applications.

Figure 7:
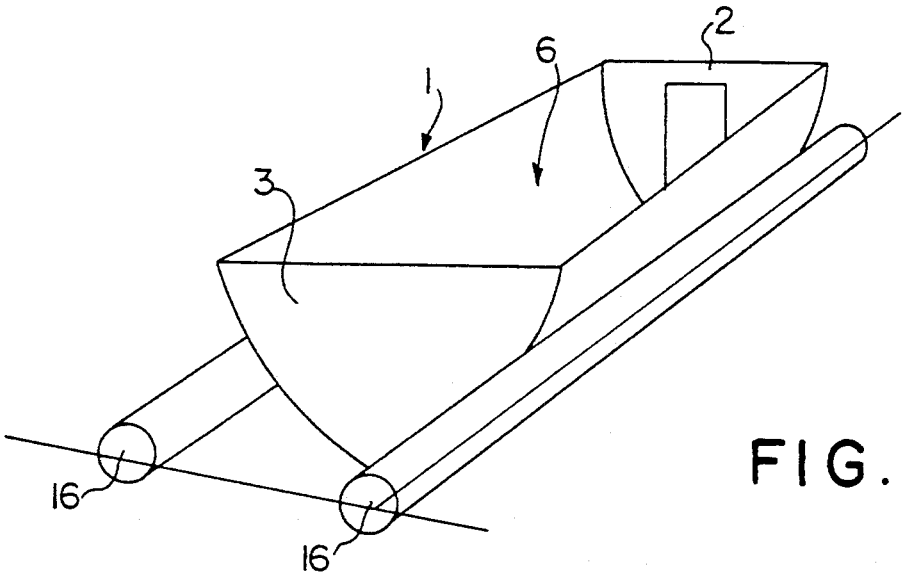
FIGS. 7 and 8 illustrate the application of a shell structure as a pontoon and a bridge.
Figure 8:
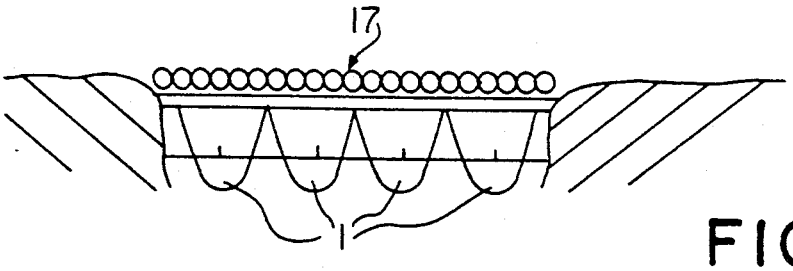

FIGS. 7 and 8 illustrate the application of a shell structure of the invention as a pontoon element. Thus, the shell structure is provided on the sides thereof with two elongated bearing members, such as logs 16, which provide for the stability of a shell structure. As shown in FIG. 8, shell structures can be placed successively with either the side faces of a housing section or the side faces of gables against each other, whereby a bridge construction covering 17 can be laid upon openings 6.

It is obvious that a shell structure of the invention offers, in addition to the above-described, mostly military applications, extensive possible civil applications, for example, as public shelters, storages, ground cellars, or the like. An opening or openings can also be provided in housing section 1. Gables 2 and 3 can be designed to be inclined towards the central portion of housing section 1 starting from edge 7. This is preferable especially for making the structures stackable on each other.

We claim:

1. A shell structure comprising:

a single body of reinforced plastic defining a hollow, open bottom housing member, said housing member including an elongate portion having a substantially parabolic cross-sectional shape and two gables closing said elongate portion at the opposite ends thereof, said gables being inclined towards the central plane of the housing member, and a flange-shaped reinforcement portion extending along the edge of said open bottom of said housing member;

said elongate member and said two gables being corrugated such that its corrugations extend substantially perpendicularly to the edge of said open bottom and wherein said corrugations of said elongate portion and said inclined gable extend in the same phase at junctures between said elongate portion and said gables.

2. A shell structure according to claim 1, wherein said flange-shaped reinforcement portion is provided with lifting means for facilitating relocation of the shell structure.

3. A shell structure according to claim 2, wherein said lifting means comprises lifting handles.

4. A shell structure as set forth in claim 1, wherein at least one opening is provided in the corrugation of one of the gables, said opening being fitted with a watertight door or hatch.

5. A shell structure as set forth in claim 1, wherein the housing member is designed as a parabolically shaped trough-like cylindrical member whose cross-section remains constant and wherein said gables are rectilinear at the edge, such that the housing member has a rectilinear shape.

6. A shell structure according to claim 1, wherein said elongate portion of said housing member is provided on either side thereof with at least one fastening member which is fixable in the ground by means of an anchoring member.

7. A shell structure according to claim 6, wherein said fastening member is a string.

8. A lightweight shell structure comprising;

a single body cylindrical housing section constructed with a substantially arcuate cross section of two sides meeting at a center portion;

corrugations in said housing section arranged substantially perpendicularly in relation to the longitudinal direction of said housing section;

two gables joined to the housing section and corrugated in the same manner as the housing section and arranged substantially perpendicularly to the bottom edge of the gables;

the corrugations of the housing section and the gables being inclined toward the center section of the housing section;

an opening into the shell structure defined by the bottom edges of the housing section and the gables; and a flange-shaped reinforcement portion provided along the edge of said opening, said flange-shaped reinforcement portion being provided with lifting means for facilitating relocation of the shell structure.

9. A shell structure according to claim 8, wherein said lifting means comprises lifting handles.

10. A shell structure as set forth in claim 8, wherein at least one opening is provided in the corrugation of one of the gables, said opening being fitted with a watertight door or hatch.

11. A shell structure comprising:

a single body of reinforced plastic defining an elongate hollow housing section having an open bottom and a substantially parabolic cross-sectional shape, and being corrugated such that its corrugations extend perpendicularly to the longitudinal direction of said housing section;

two gables at opposite end portions of said housing section, said gables being corrugated such that its corrugations extend perpendicularly to the bottom edge of the gables;

the corrugations of said housing section and the gables, which are arranged in an inclined position towards a central portion of said housing section, extendind in the same phase at junctures between the housing section and the gables;

a flange-shaped reinforcement portion formed along the bottom edges of said gables and said housing section and wherein said housing section is provided on either side thereof with at least one fastening member which is fixable to the ground by anchoring means.

12. A shell structure as set forth in claim 11, wherein at least one opening is provided in the corrugation of one of the gables said opening being fitted with a watertight door or hatch.

* * * * *